US007147569B2

(12) United States Patent
Tang et al.

(10) Patent No.: US 7,147,569 B2
(45) **Date of Patent: *Dec. 12, 2006**

(54) PUTTER-TYPE CLUB HEAD

(75) Inventors: Larry G. Tang, Carlsbad, CA (US); Augustin W. Rollinson, San Diego, CA (US); Roger Cleveland, Los Angeles, CA (US)

(73) Assignee: Callaway Golf Company, Carlsbad, CA (US)

( * ) Notice: Subject to any disclaimer, the term of this patent is extended or adjusted under 35 U.S.C. 154(b) by 215 days.

This patent is subject to a terminal disclaimer.

(21) Appl. No.: 10/904,236

(22) Filed: Oct. 29, 2004

(65) Prior Publication Data

US 2006/0094522 A1 May 4, 2006

(51) Int. Cl.
*A63B 69/36* (2006.01)
*A63B 53/04* (2006.01)

(52) U.S. Cl. ..... 473/249; 473/251; 473/340; 473/342; 473/349

(58) Field of Classification Search ..... 473/251–254, 473/324–350, 249; D21/736–746, 759
See application file for complete search history.

(56) References Cited

U.S. PATENT DOCUMENTS

| | | | |
|---|---|---|---|
| 1,562,956 | A | 11/1925 | Guerne |
| D148,431 | S | 1/1948 | Lund |
| D196,736 | S | 10/1963 | DeCarlo |
| D229,204 | S | 11/1973 | Romero |
| D230,293 | S | 2/1974 | Gall |
| D230,294 | S | 2/1974 | Gall |
| 3,836,153 | A | 9/1974 | Dance, Jr. |
| 3,841,640 | A | 10/1974 | Gaulocher |
| 3,937,474 | A | 2/1976 | Jepson et al. |
| 4,330,128 | A | 5/1982 | Morelli |
| 4,659,083 | A | 4/1987 | Szczepanski |
| 4,679,792 | A | 7/1987 | Straza et al. |
| 4,681,322 | A | 7/1987 | Straza et al. |
| 4,688,798 | A | 8/1987 | Pelz |
| 4,754,976 | A | 7/1988 | Pelz |
| 4,793,616 | A | 12/1988 | Fernandez |
| 4,798,383 | A | 1/1989 | Nagasaki et al. |
| 4,801,146 | A | 1/1989 | Honma |
| 4,804,188 | A | 2/1989 | McKee et al. |
| D309,765 | S | 8/1990 | Pelz |
| D317,962 | S | 7/1991 | Pelz |
| 5,046,740 | A | 9/1991 | D'earth |
| 5,255,918 | A | 10/1993 | Anderson et al. |
| 5,303,922 | A | 4/1994 | Lo |
| 5,316,305 | A | 5/1994 | McCabe |

(Continued)

*Primary Examiner*—Sebastiano Passaniti
(74) *Attorney, Agent, or Firm*—Michael A. Catania; Elaine H. Lo

(57) ABSTRACT

A putter-type club head (20) having a body (22) and a peripheral mass belt (23) is disclosed herein. The putter-type club head (20) has a body (22) that is preferably composed of an aluminum alloy. The body (22) preferably has a face portion (24), a crown portion (26), a sole portion (28) and a column portion (30). The face portion (24), the crown portion (26), the sole portion (28) and the peripheral mass belt (23) define a central aperture (32). The crown portion (26) extends rearward from the face portion (24). The central aperture (32) separates the crown portion (26) from the sole portion (28) and the face portion (24) from the central mass portion (80). The crown portion (26) preferably has an alignment means (40) thereon for aiming a golf ball during putting which preferably comprises three circular inserts (40*a–c*).

18 Claims, 4 Drawing Sheets

U.S. PATENT DOCUMENTS 5,332,223 A 7/1994 Johnson
5,368,302 A 11/1994 Thomas
5,447,311 A 9/1995 Viollaz et al.
5,458,332 A 10/1995 Fisher
5,460,377 A 10/1995 Schmidt et al.
5,464,212 A 11/1995 Cook
5,464,218 A 11/1995 Schmidt et al.
5,470,068 A 11/1995 Schmidt et al.
5,480,153 A 1/1996 Igarashi
5,482,281 A 1/1996 Anderson
5,485,997 A 1/1996 Schmidt et al.
5,489,098 A 2/1996 Gojny et al.
5,497,993 A 3/1996 Shan
5,524,331 A 6/1996 Pond
5,531,439 A 7/1996 Azzarella
5,575,472 A 11/1996 Maggerman et al.
5,586,948 A 12/1996 Mick
5,620,382 A 4/1997 Cho et al.
5,674,132 A 10/1997 Fisher
5,685,784 A 11/1997 Butler
5,690,562 A 11/1997 Sturm
D389,208 S 1/1998 Phillips
D389,539 S * 1/1998 Moore ..... D21/739
5,718,644 A 2/1998 Donofrio
5,743,813 A 4/1998 Chen et al.
5,746,664 A 5/1998 Reynolds, Jr.
D395,692 S 6/1998 Butler
5,769,736 A 6/1998 Sato
5,782,706 A 7/1998 DePriest
5,816,936 A 10/1998 Aizawa et al.
5,830,078 A 11/1998 McMahan
5,839,974 A 11/1998 McAllister
5,890,973 A 4/1999 Gamble
5,921,871 A 7/1999 Fisher
5,924,939 A 7/1999 Grace et al.
5,931,743 A 8/1999 Baker et al.
5,951,412 A 9/1999 Rose et al.
D422,328 S 4/2000 Lannoch
D426,599 S 6/2000 Morgan et al.
D427,262 S 6/2000 Frazetta
D428,088 S 7/2000 Cameron et al.
D428,457 S 7/2000 Rollinson et al.
6,086,484 A 7/2000 Uebelhor
D435,275 S 12/2000 Sizemore
6,224,496 B1 5/2001 Rowland et al.
6,238,302 B1 5/2001 Helmstetter et al.
6,273,831 B1 8/2001 Dewanjee
6,277,033 B1 8/2001 Krumme et al.
D448,437 S 9/2001 Colucci
D449,085 S 10/2001 Breier et al.
D457,586 S 5/2002 Tang
D458,656 S 6/2002 Tang
D461,514 S * 8/2002 Tang et al. ..... D21/742
D461,515 S * 8/2002 Tang et al. ..... D21/742
D461,861 S * 8/2002 Tang et al. ..... D21/742
6,506,125 B1 1/2003 Helmstetter et al.
D485,323 S * 1/2004 Wagner et al. ..... D21/744
D496,418 S * 9/2004 Tang et al. ..... D21/738
D499,778 S * 12/2004 Cameron ..... D21/742
D502,748 S * 3/2005 Burrows ..... D21/742
D506,796 S * 6/2005 Li ..... D21/742
6,929,564 B1 * 8/2005 Olsavsky et al. ..... 473/340

* cited by examiner

PUTTER-TYPE CLUB HEAD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a putter-type club head. More specifically, the present invention relates to a putter-type club head having a rearward center of gravity.

2. Description of the Related Art

The golf industry has been inventing putters that make the game of golf easier for the high handicap player. One such putter is disclosed in U.S. Pat. No. 4,688,798 to David Pelz. The Pelz patent discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter.

Yet another patent that discloses an alignment means is Great Britain Patent Application Number 4,659,083 to Lilley. The Lilley patent also discloses a group of lines that converge toward the center of the face of a putter.

Another example is Schmidt et al., U.S. Pat. No. 5,470,068, for a Golf Putter With Dished Bottom Surfaces which discloses a putter composed of a single cast material and having a hollow interior.

Another example is Uebelhor, U.S. Pat. No. 6,086,484, which was filed on Mar. 20, 1998 for a Golf Putter Head. Uebelhor discloses a putter head with a U-shaped body and a block within the middle. The block has a lower specific gravity than the U-shaped body.

Yet another example is Rose et al., U.S. Pat. No. 5,951,412 originally filed in January of 1996 for a Golf Club, Particularly A Putter. The Rose patent discloses a center portion composed of a light metal material and the heel and toe portions composed of heavier metals. The metals are forged or cast to create the putter head.

Another example is Fernandez, U.S. Pat. No. 4,793,616 for a Golf Club, which was originally filed in 1984, discloses a lightweight composite material molded to a hard, high density material for distribution of mass. Fernandez discloses a composite shell with a high density insert composed of tungsten or some other high density material.

Although these inventions have provided new and improved putters for making the game of golf more enjoyable for high handicap players, the prior art has not optimized a putter by making it more forgiving and assisting in alignment.

BRIEF SUMMARY OF THE INVENTION

One aspect of the present invention is a putter-type club head having a body and a peripheral mass belt. The body has a face portion, a crown portion, a sole portion and a column portion. The crown portion extends rearward from the face portion to cover the column portion. The sole portion extends rearward from face portion. The peripheral mass belt is attached to the body. The peripheral mass belt has a central mass portion, a heel arc member extending outward from the central mass portion and a toe arc member extending outward from the central mass member.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
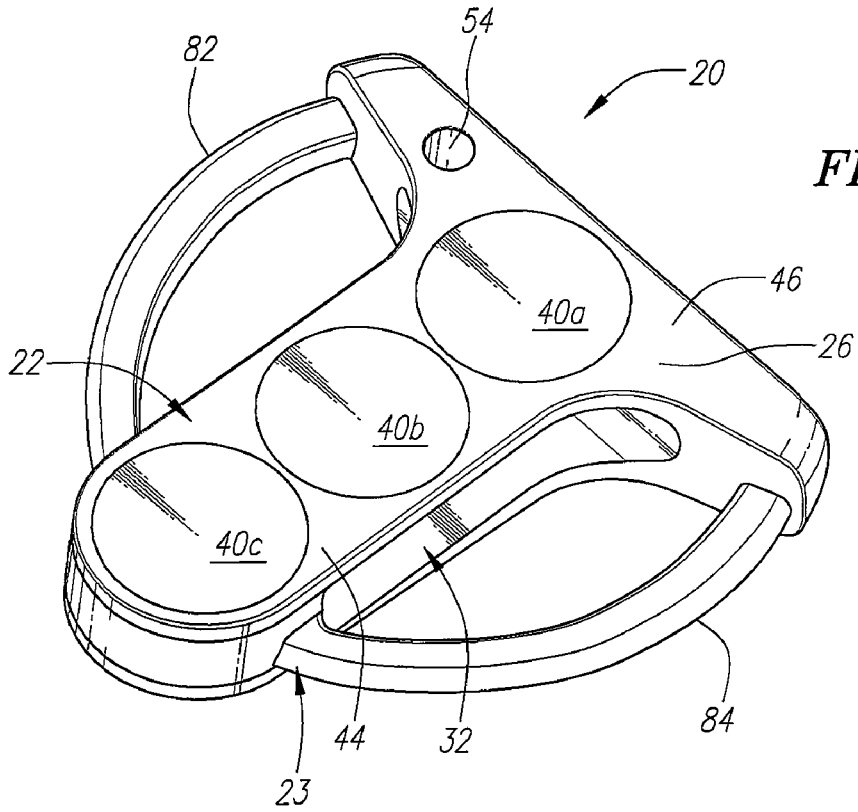
FIG. 1 is a top perspective view of a putter-type club head.

As shown in FIGS. 1–6, a putter-type club head of the present invention is generally designated 20. The club head 20 preferably includes a body 22 and a peripheral mass belt 23. In a preferred embodiment, the body 22 is composed of a material having a density ranging from 0.90 g/cm$^3$ to 6.0 g/cm$^3$. A preferred metal for the body 22 is an aluminum alloy. Alternative materials for the body 22 include aluminum, titanium, titanium alloys, magnesium, magnesium alloys, and the like. The body 22 is preferably formed as a single cast structure using known investment casting techniques. However, those skilled in the pertinent art will recognize that alternative forming techniques such as milling, welding forged or formed pieces, and the like may be utilized without departing from the scope and spirit of the present invention.

The body 22 preferably weighs from 100 grams to 300 grams, more preferably from 150 grams to 275 grams, even more preferably from 200 grams to 250 grams and most preferably 210 grams.

The peripheral mass belt 23 is preferably composed of a material that has a density greater than the density of the material of the body 22. In a preferred embodiment, the peripheral mass belt 23 is composed of a material having a density ranging from 6.0 g/cm$^3$ to 20.0 g/cm$^3$, and more preferably from 7.0 g/cm$^3$ to 10.0 g/cm$^3$. In a preferred embodiment, the peripheral mass belt 23 is composed of stainless steel. In alternative embodiments, the peripheral mass belt 23 is composed of zinc, brass, copper, gold, silver, tungsten, tungsten-based alloys, iron-based alloys, and copper-based alloys.

The peripheral mass belt 23 preferably weighs from 80 grams to 300 grams, more preferably from 90 grams to 200 grams, even more preferably from 100 grams to 180 grams, even more preferably from 120 grams to 135 grams, and most preferably 127 grams.

The club head 20 preferably has a mass ranging from 250 grams to 500 grams, more preferably from 300 grams to 400 grams, and most preferably 340 grams.

Figure 4:
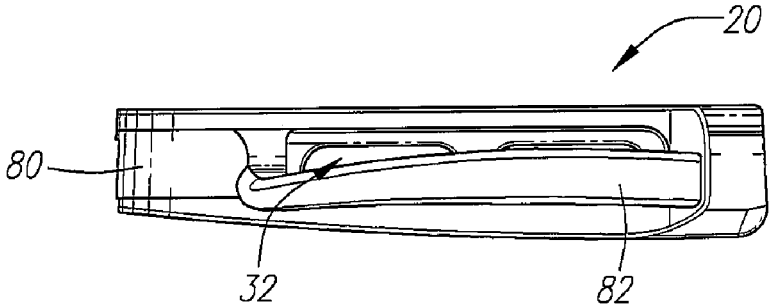
FIG. 4 is a side plan view of putter-type club head of FIG. 1.
Figure 4A:
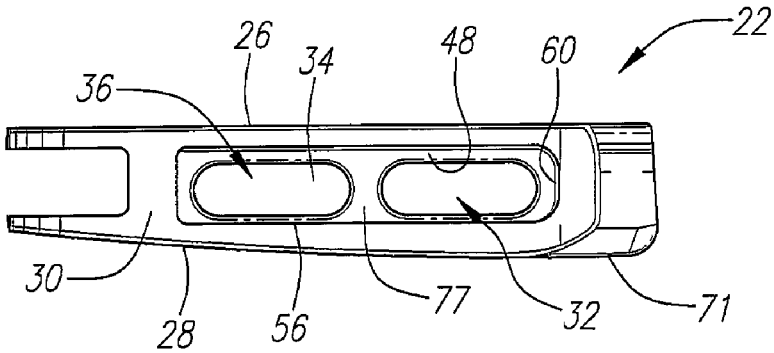
FIG. 4A is a side plan view of a body of the putter-type club head of FIG. 4 without a peripheral mass belt.
Figure 5:
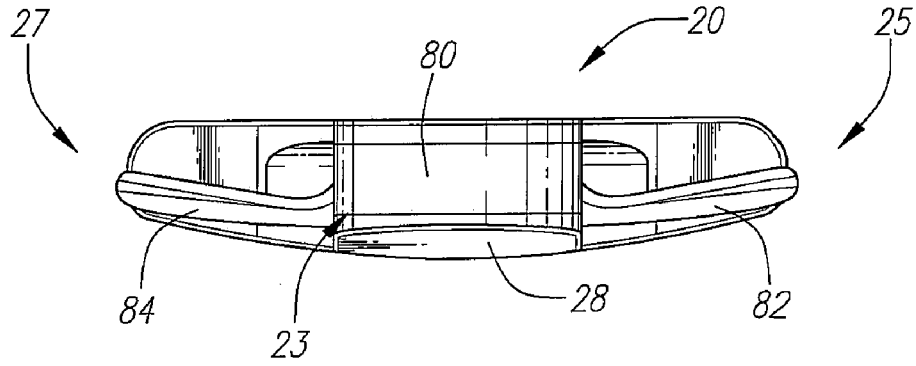
FIG. 5 is a rear plan view of the putter-type club head of FIG. 1.
Figure 6:
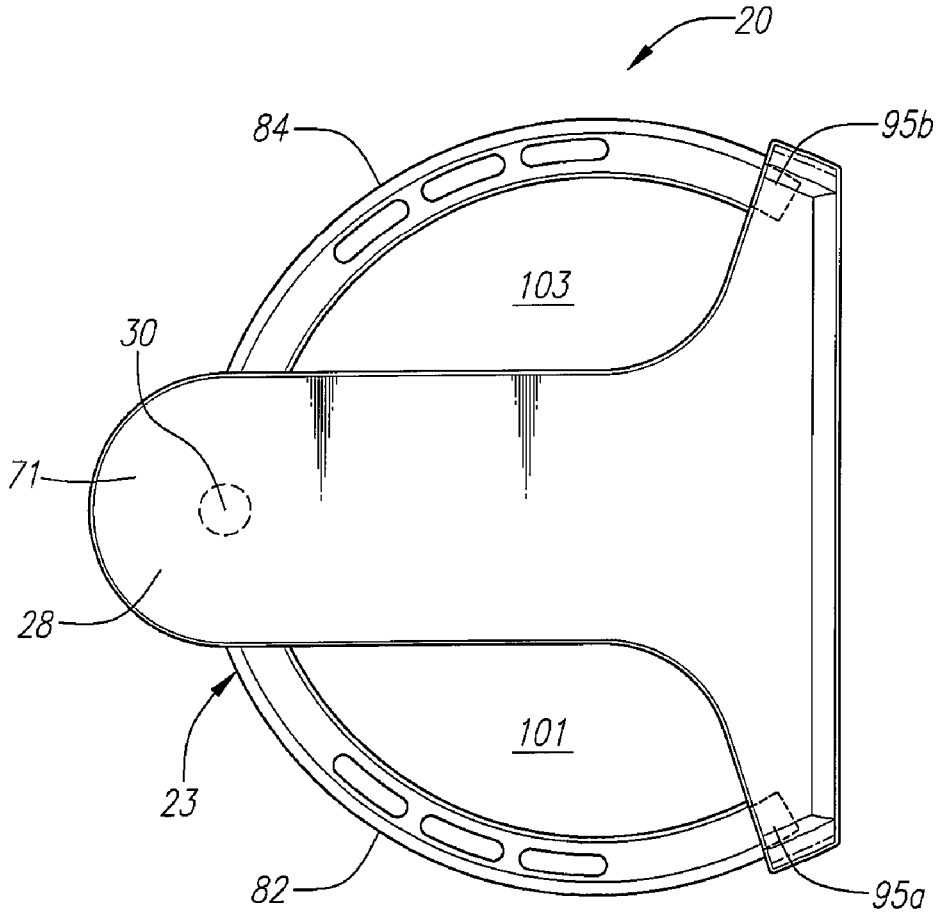
FIG. 6 is a bottom plan view of the putter-type club head of FIG. 1.

In a preferred embodiment, the body 22 has a face portion 24, a crown portion 26, a sole portion 28 and a column portion 30. The face portion 24, the crown portion 26, the sole portion 28, the column portion 30 and the peripheral mass belt 23 define a central aperture 32 that extends through the body 22. The central aperture 32 has a heel opening 34 at a heel end 27 of the body 22 and a toe opening 36 at a toe end 25 of the body 22. The central aperture 32 horizontally separates the face portion 24 from the peripheral mass belt 23, and the central aperture 32 vertically separates the crown portion 26 from the sole portion 28. Due to the length of the crown portion 26, the body 22 preferably has an interior column 77, as shown in FIG. 4A, within the central aperture 32. The central aperture 32, in connection with the peripheral mass belt 23, allows for the center of gravity of the club head 20, "CG", to be moved rearward from the face portion 24.

In a preferred embodiment, the CG of the club head 20 is positioned within the central aperture 32, and thus the CG is not positioned within material of the club head 20 but instead the CG lies outside the material in space within the central aperture 32. Preferably, the CG is located between 0.25 inch and 1.0 inch from an external surface 71 of the sole portion 28, more preferably 0.50 inch to 0.75 inch, and most preferably 0.73 inch from the external surface 71 of the sole portion 28. Also, preferably the CG of the club head 20 is located 1.50 inches to 3.5 inches rearward from the external surface 58 of the face portion 24, more preferably 2.0 inches to 3.0 inches, and most preferably 2.85 inches from the external surface 58 of the face portion 24.

In addition to assisting in the rearward positioning of the CG, the peripheral mass belt 23 is a rearward support structure for crown portion 26. The peripheral mass belt 23 preferably ranges from 20 to 50 volume percent of the club head 20 and ranges from 40 to 75 weight percent of the club head 20.

The sole portion 28 preferably has an approximate T-shape. The external surface 71 of the sole portion 28 contacts the ground when the club head 20 is used with a shaft and grip, both not shown, as a putter. The CG of the club head 20 preferably lies above the sole portion 28.

The crown portion 26 extends rearward from the face portion 24. The crown portion 26 has a central elongated section 44 and a front section 46. The front section 46 has a width W' that extends from the heel end 27 to the toe end 25 of the face portion 24, and gradually narrows as the front section 46 transitions into the central elongated section 44. The width, W', preferably ranges from 3.0 inches to 6.0 inches, more preferably from 4.5 inches to 5.5 inches, and most preferably 5.22 inches. The central elongated section 44 has a width W" that is less than the width w' of the front section 46. The width, W", preferably ranges from 1.0 inch to 3.0 inches, more preferably from 1.5 inches to 2.25 inches, and most preferably 1.8 inches. The internal surface 48 of the crown portion 26 partially defines the central aperture 32. The crown portion preferably has a thickness that ranges from 0.10 inch to 0.50 inch, more preferably 0.15 inch to 0.30 inch.

The external surface 38 of the crown portion 26 preferably has an alignment means 40 thereon. The external surface 38 also preferably has an aperture 54 for placement of a shaft, not shown, therein.

Figure 1A:
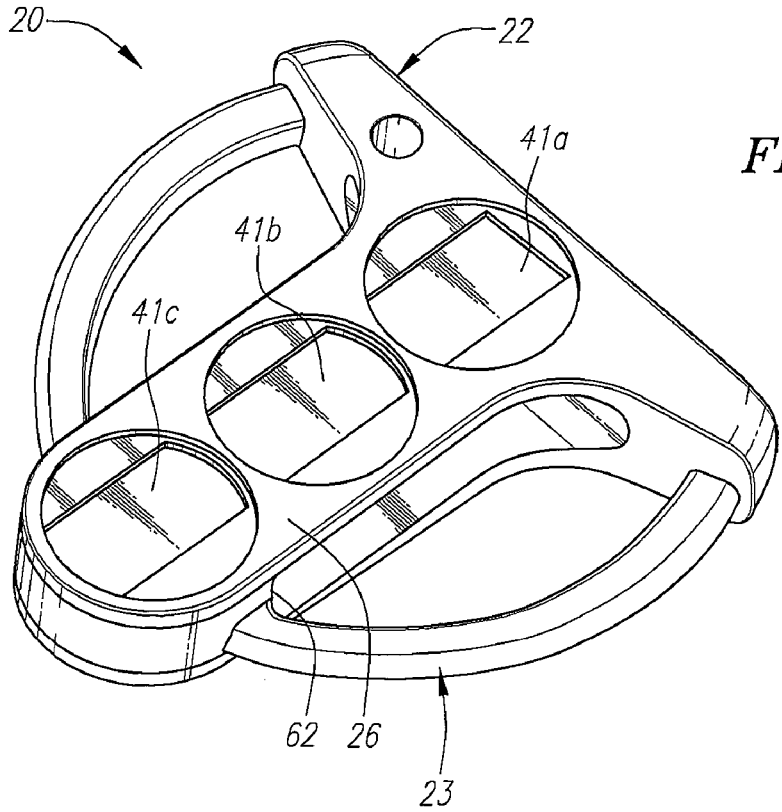
FIG. 1A is a top perspective view of a putter-type club head illustrating crow recesses.

A preferred alignment means 40 is first insert 40*a*, second insert 40*b* and third insert 40*c* disposed within first recess 41*a*, second recess 41*b* and third recess 41*c* of the crown portion 26. Recesses 41*a–c* are shown in FIGS. 1A and 1B. The depth of each of the recesses 41*a–c* is preferably within 0.05 inch to 0.50 inch, more preferably 0.1 inch to 0.250 inch. Each of the circular inserts 40*a–c* preferably have a thickness ranging from 0.05 inch to 0.50 inch, more preferably 0.1 inch to 0.250 inch.

In a preferred embodiment, each of the circular inserts 40*a–c* are preferably composed of a thermosetting polyurethane material such as described in U.S. Pat. No. 6,273,831, entitled Golf Club Head with A Polymer Insert, assigned to Callaway Golf (the assignee of the Present Application), which is hereby incorporated by reference in its entirety. Alternatively, each of the circular inserts 40*a–c* may be composed of a thermoplastic polyurethane. Each of the circular inserts 40*a–c* is preferably colored white, through painting or doping of the polyurethane with coloring agents, and each circular insert 40*a–c* preferably has a texture of a golf ball cover. Each of the circular inserts 40*a–c* preferably has a diameter ranging from 1.62 inches to 1.70 inches, and most preferably 1.68 inches.

Alternative alignment means are disclosed in U.S. Pat. No. 4,688,798, entitled Golf Club And Head Including Alignment Indicators, assigned to the Callaway Golf (the assignee of the Present Application), which pertinent parts are hereby incorporated by reference. As disclosed in U.S. Pat. No. 4,688,798, the alignment means assists a golfer in properly aiming a golf ball toward a hole when putting. Alternative alignment means, including a large white strip may be utilized in the present invention.

The face portion 24 preferably has a thickness ranging from 0.10 inch to 0.50 inch, more preferably 0.20 inch to 0.35 inch. The face portion 24 has an internal surface 60 that partially defines the central aperture 32. Preferably, the external surface 58 of the face portion 24 is milled for striking a golf ball at a relatively slow speed for putting. Alternatively, the external surface 58 of the face preferably has a face recess, not shown, therein with a face insert disposed therein such as disclosed in U.S. Pat. No. 6,238,302, entitled A Golf Club Head With An Insert Having Integral Tabs, assigned to Callaway Golf (the assignee of the Present Application), which is hereby incorporated by reference in its entirety. As disclosed in U.S. Pat. No. 6,238,302, the face insert is preferably composed of a thermosetting polyurethane material and is preferably colored white.

The putter-type club head 20 preferably has a length, L, from the face portion 24 to the rearward most end of the peripheral mass belt 23, preferably ranging from 3.0 inches to 6.0 inches, more preferably from 4.5 inches to 5.5 inches, and most preferably 5.07 inches. In one alternative embodiment, the putter-type club head 20 has a length, L, that is equal to the width, W'.

As mentioned previously, the central aperture is defined by the internal surface 60 of the face portion 24, the internal surface 48 of the crown portion 26, the internal surface 56 of the sole portion 28 and the internal surface 62 of the peripheral mass belt 23, and the internal surface of the column portion 30. The distance from the internal surface 48 of the crown portion 26 to the internal surface 56 of the sole portion 28 preferably ranges from 0.01 inch to 1.50 inches, more preferably 0.25 inch to 1.0 inch, and most preferably 0.5 inch. The distance from the internal surface 60 of the face portion 24 to the internal surface 62 of peripheral mass belt 23 preferably ranges from 1.0 inch to 3.50 inches, more preferably from 1.5 inches to 3.0 inches, and most preferably 2.00 inches.

Figure 2:
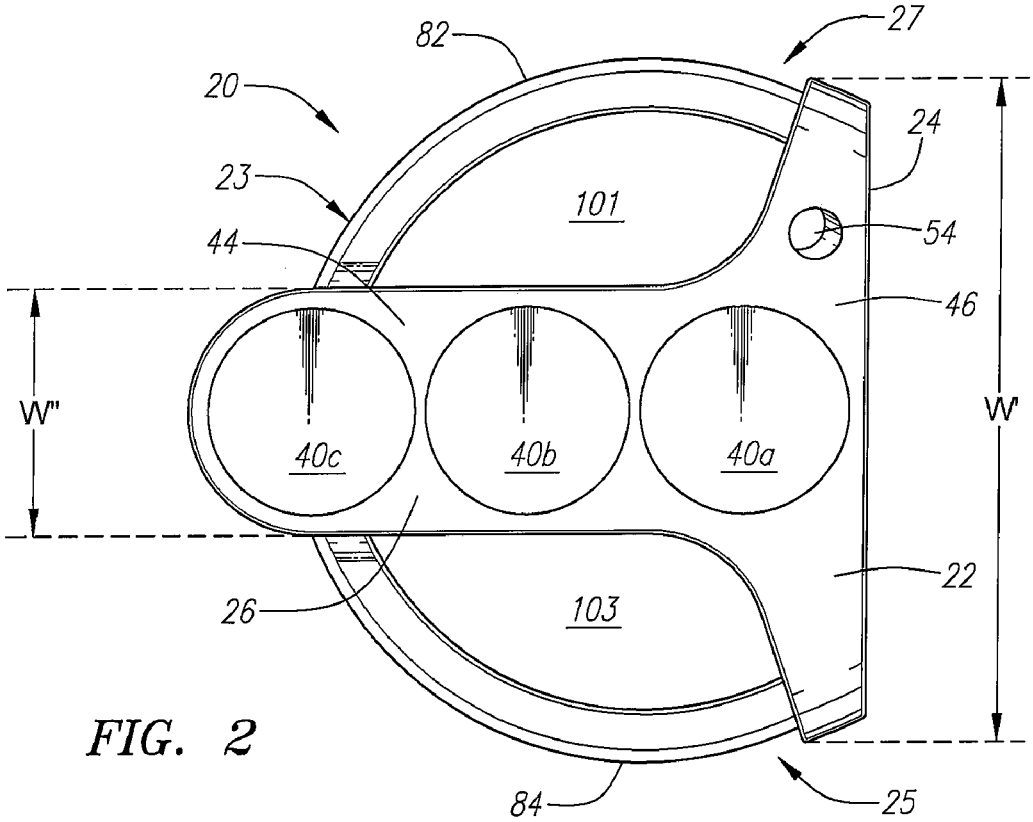
FIG. 2 is a top plan view of putter-type club head of FIG. 1.
Figure 2A:
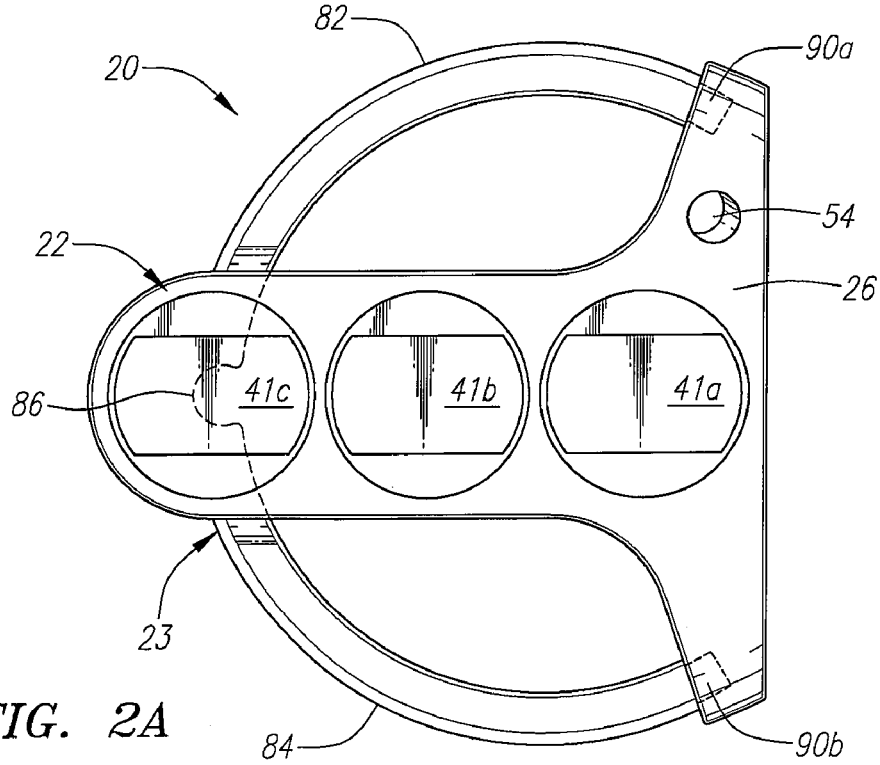
FIG. 2A is a top plan view of a putter-type club head illustrating crow recesses.
Figure 3:
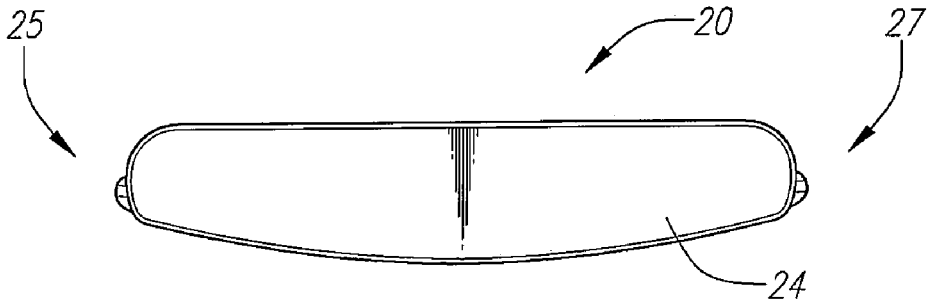
FIG. 3 is a front plan view of putter-type club head of FIG. 1.

The peripheral mass belt 23 preferably includes a central mass portion 80, a heel arc member 82 and a toe arc member 84. The heel arc member 82 and the toe arc member 84 extend outward from the central mass portion 80 on opposing ends of the central mass portion 80. The central mass portion 80 has a recess 86 (as shown in dashed lines in FIG. 2A) for placement of the column portion 30 therein. The heel arc member 82 has a projection 90*a* (shown in dashed lines in FIG. 2A), for placement within a recess 95*a* (shown in dashed lines in FIG. 6) of the face portion 24. The toe arc member 84 has a projection 90*b* (shown in dashed lines in FIG. 2A) for placement within a recess 95*b* (shown in dashed lines in FIG. 6) of the face portion 24. The peripheral mass belt 23 is preferably bonded to the body 22 using an adhesive, with the adhesive preferably placed around the column portion 30 that engages the central mass portion 80 and within the recesses 95*a–b*. Alternatively, the peripheral mass belt 23 is press-fitted into engagement with the body, or secured using screws.

The putter-type club head 20 preferably has a moment of inertia about the Izz axis through the center of gravity ranging from 3750 g-cm$^2$ to 4200 g-cm$^2$, and more preferably 3950 g-cm$^2$ to 4100 g-cm$^2$. The Izz axis extends from the sole to the crown.

In a preferred embodiment, the heel arc member 82 and the body 22 form a heel space 101, and the toe arc member 84 and the body 22 form a toe space 103. The heel space 101 and the toe space 103 allow for the mass of the club head 20 to be extended outward from the center of gravity to increase the moment of inertia without adding more mass to the club head 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter-type club head comprising:

a body having a face portion, a crown portion, a sole portion and a column portion, the crown portion extending rearward from the face portion to cover the column portion, the sole portion extending rearward from the face portion; and a peripheral mass belt attached to the body, the peripheral mass belt having a central mass portion, a heel arc member extending outward from the central mass portion and a toe arc member extending outward from the central mass member;

wherein the face portion, the crown portion, the sole portion and the central mass portion of the peripheral mass belt define a central aperture through the body having a heel end opening and a toe end opening, and the central aperture separates the crown portion from the sole portion and the face portion from the central mass portion;

wherein the body has a length, L, from the face portion to the rearward most end of the peripheral mass belt ranging from 3.0 inches to 6.0 inches.

2. The putter-type club head according to claim 1 further comprising a plurality of recesses on an external surface of the crown portion, each of the plurality of recesses having a circular shape with a diameter ranging from 1.62 inches to 1.70 inches;

a plurality of circular inserts, each of the plurality of circular inserts disposed within a corresponding recess of the plurality of recesses.

3. The putter-type club head according to claim 1 wherein each of the plurality of circular inserts is composed of a thermosetting polyurethane material, and each of the plurality of circular inserts has a white color.

4. A putter-type club head comprising:

a face portion having a recess with a face insert disposed therein;

a sole portion extending rearward from the face portion, the sole portion having an internal surface and an external surface;

a crown portion extending rearward from the face portion, the crown portion having a central elongated section and a forward section, the forward section having a width from a heel end of the face portion to a toe end of the face portion from between 3.0 inches to 6.0 inches, the forward section having a width greater than a width of the central elongated portion;

an alignment means disposed on an external surface of the crown portion; and a peripheral mass belt attached to the body, the peripheral mass belt having a central mass portion, a heel arc member extending outward from the central mass portion and a toe arc member extending outward from the central mass member;

wherein the putter-type club head has a length, L, from the face portion to the rearward most end of the peripheral mass belt ranging from 3.0 inches to 6.0 inches.

5. The putter-type club head according to claim 4 wherein the center of gravity of the club head is located from between 0.25 inch to 1.0 inch upward from the external surface of the sole portion.

6. The putter-type club head according to claim 4 wherein the center of gravity of the club head is located 1.50 inches to 3.5 inches rearward from the external surface of the face portion.

7. The putter-type club head according to claim 4 wherein the alignment means is composed of three circular inserts.

8. The putter-type club head according to claim 7 wherein the three circular inserts are composed of a thermosetting polyurethane.

9. The putter-type club head according to claim 7 wherein the three circular inserts have equal diameters.

10. A putter-type club head comprising:

a body having a face portion, a crown portion, a sole portion and a column portion, the crown portion extending rearward from the face portion to cover the column portion, the sole portion extending rearward from the face portion; and a peripheral mass belt attached to the body, the peripheral mass belt having a central mass portion, a heel arc member extending outward from the central mass portion and a toe arc member extending outward from the central mass member;

wherein the putter-type club head has a length, L, from the face portion to the rearward most end of the peripheral mass belt ranging from 3.0 inches to 6.0 inches.

11. The putter-type club head according to claim 10 wherein the peripheral mass belt ranges from 20 to 50 volume percent of the putter-type club head and ranges from 40 to 60 weight percent of the body.

12. The putter-type club head according to claim 10 wherein the peripheral mass belt is composed of stainless steel.

13. A putter-type club head comprising:

a body having a face portion, a crown portion, a sole portion and a column portion, the crown portion extending rearward from the face portion to cover the column portion, the sole portion extending rearward from the face portion, the crown portion having an alignment means comprising three circular inserts; and a peripheral mass belt attached to the body, the peripheral mass belt having a central mass portion, a heel arc member extending outward from the central mass portion and a toe arc member extending outward from the central mass member;

wherein the peripheral mass belt has a mass ranging from 100 grams to 180 grams.

14. A putter-type club head comprising:

a body having a face portion, a crown portion, a sole portion and a column portion, the crown portion extending rearward from the face portion to cover the column portion, the sole portion extending rearward from face portion, the crown portion having an alignment means comprising three circular inserts; and a peripheral mass belt attached to the body, the peripheral mass belt having a central mass portion, a heel arc member extending outward from the central mass portion and a toe arc member extending outward from the central mass member;

wherein the heel arc member and the body form a heel space and the toe arc member and the body form a toe space.

15. The putter-type club head according to claim 14 wherein the body is composed of a material selected from the group consisting of aluminum, aluminum alloy, magnesium, magnesium alloy, titanium and titanium alloy.

16. The putter-type club head according to claim 14 wherein the body is composed of a material having a density ranging from 0.90 g/cm$^3$ to 6.0 g/cm$^3$.

17. The putter-type club head according to claim 14 wherein the peripheral mass belt is composed of a material having a density ranging from 7.00 g/cm$^3$ to 10.0 g/cm$^3$.

18. A putter-type club head comprising:

a body composed of an aluminum material having a density ranging from 2.0 g/cm$^3$ to 3.0 g/cm$^3$, a body having a face portion, a crown portion, a sole portion and a column portion, the crown portion extending rearward from the face portion to cover the column portion, the sole portion extending rearward from the face portion, the crown portion having an alignment means comprising three circular inserts; and a peripheral mass belt attached to the body, the peripheral mass belt having a central mass portion, a heel arc member extending outward from the central mass portion and a toe arc member extending outward from the central mass member, the peripheral mass belt composed of a material having a density ranging from 6.0 g/cm$^3$ to 20.0 g/cm$^3$.

* * * * *